United States Patent [19]

D'Onofrio

[11] Patent Number: 4,737,882

[45] Date of Patent: Apr. 12, 1988

[54] PROPORTIONAL SOLENOID VALVE CONTROL CIRCUIT

[75] Inventor: Anthony D'Onofrio, West Hartford, Conn.

[73] Assignee: Honeywell Inc., Minneapolis, Minn.

[21] Appl. No.: 12,473

[22] Filed: Feb. 9, 1987

[51] Int. Cl.[4] ..... H01H 47/32

[52] U.S. Cl. ..... 361/154; 361/160

[58] Field of Search ..... 361/154, 146, 160, 152, 361/153

[56] References Cited

U.S. PATENT DOCUMENTS 4,516,185 5/1985 Culligan et al. ..... 361/154

*Primary Examiner*—L. T. Hix

*Assistant Examiner*—David M. Gray

*Attorney, Agent, or Firm*—Mitchell J. Halista; Albin Medved

[57] ABSTRACT

A proportional solenoid valve control circuit uses a solenoid current driver, a feedback circuit for providing a feedback signal representative of an output current supplied by the drive means, input signal means for connection to a source of a control signal representative of a desired current to be supplied by the driver means, signal comparison means for comparing the feedback signal with the control signal to produce an error signal representing the difference therebetween, timer means connected to the comparison means for producing an output signal having a frequency dependent on the magnitude of the error signal and a circuit for applying the output signal to the current driver to produce the output current from the driver proportional to the output signal.

6 Claims, 2 Drawing Sheets

PROPORTIONAL SOLENOID VALVE CONTROL CIRCUIT

BACKGROUND OF THE INVENTION

1. Field of the Invention

The present invention relates to solenoid valves. More specifically, the present invention is directed to a control circuit for a proportional solenoid valve.

2. Description of the Prior Art

Proportional solenoid valves are available in the form of direct lift-type valves. Such valves are used in applications requiring valves that are voltage controllable and not simply "on" and "off" poppet-type valves, i.e., the valve plunger position must be controlled by the magnitude of the solenoid input voltage. Typically, the greater the input voltage, the greater the plunger lift and, consequently, the greater the flow rate or downstream pressure produced by the valve. The valve must be specially designed designed to perform this proportional function, and the solenoid drive circuit must be adapted to meet the unique electrical characterstics of such a valve. For example, the heating of the valve while attempting to maintain a plunger position produces an increase in the coil resistance which increase, for the same input voltage, decrease the solenoid current. The current decrease reduces the magnetic force and allows the plunger to drop to ultimately reduce the flow rate or downstream pressure. Such an undesired decrease in the plunger lift is effective to produce an erroneaous valve operation which results in an undesired flow rate or downstream pressure. Further, such solenoid drive circuits have been continuous drive arrangements which simply maintain a continuous solenoid drive current at a value theoretically resulting in the desired plunger lift. Such a continuous operation exacerbates the aforesaid heating problem of the solenoid coil as well as wasting electrical energy during the valve operation.

Accordingly, it would be desirable to provide a control circuit for a proportional valve which would maintain a desired plunger position by compensating for such a resistance change of the solenoid coil during the operation of the valve and minimize electrical power consumption during a valve operation.

SUMMARY OF THE INVENTION

An object of the present invention is to provide an improved control circuit for a proportional solenoid valve.

In accomplishing and other objects, there has been provided, in accordance with the present invention, a current control circuit for a solenoid coil uses a solenoid current driver means, a feedback circuit for providing a feedback signal representative of an output current supplied by said driver means, input signal means for connection to a source of a control signal representative of a desired current to be supplied by the driver means, signal comparison means for comparing the feedback signal with the control signal to produce an error signal representing the difference therebetween, timer means connected to the comparison means for producing an output signal having a frequency dependent on the magnitude of the error signal and a circuit for applying the output signal to the current driver means to produce the output current from the driver means proportional to the output signal.

BRIEF DESCRIPTION OF THE DRAWING

A better understanding of the present invention may be had when the following detailed description is read in connection with the accompanying drawings, in which.

DESCRIPTION OF THE PREFERRED EMBODIMENT

Figure 1:
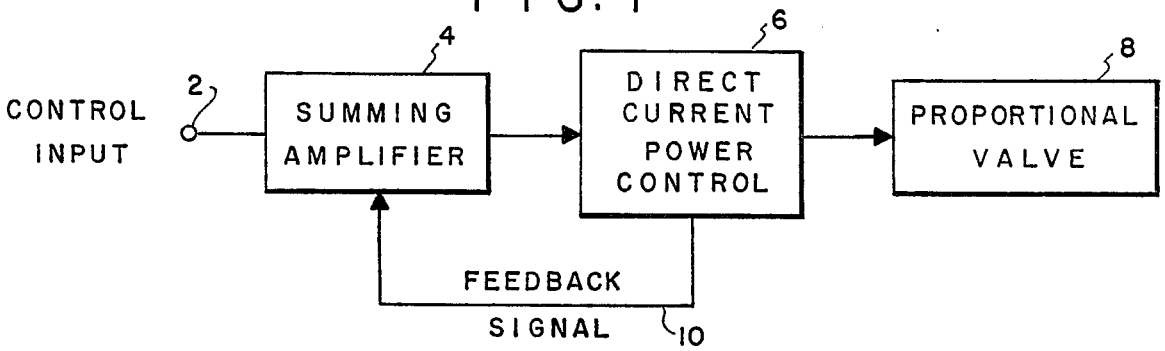
FIG. 1 is a block diagram showing a basic control system for a proportional valve.

Referring to FIG. 1 in more detail, there is shown a block diagram of a proportional solenoid valve control system utilizing a control signal applied to a control input 2. The input 2 is connected to an input of a summing amplifier 4 which, in turn, controls a direct current (D.C.) power control circuit 6. The output of the D.C. power control circuit 6 is connected to a solenoid coil of a proportional valve 8 to supply an energizing current to control the lift of a plunger or armature in the valve 8. A feedback signal on a feedback line 10 from the power control circuit 6 is applied to the summing amplifier 4 as an error signal proportional to the current through the solenoid coil, i.e., the lift of the valve plunger. This feedback signal is summed or compared by the summing amplifier 4 with the control input signal to produce a modification of the solenoid current in a direction to reduce the difference between the error signal and the control signal to a negligible level. Such a high compliance current loop is effective to compensate for the resistance changes produced by a temperature increase of the solenoid coil. However, it does not compensate for other effects which can limit the range of plunger control, e.g., a temperature increase in the output driver used to supply the current to the coil, and it uneconomically dissipates electrical energy by its continuous operation.

Figure 2:
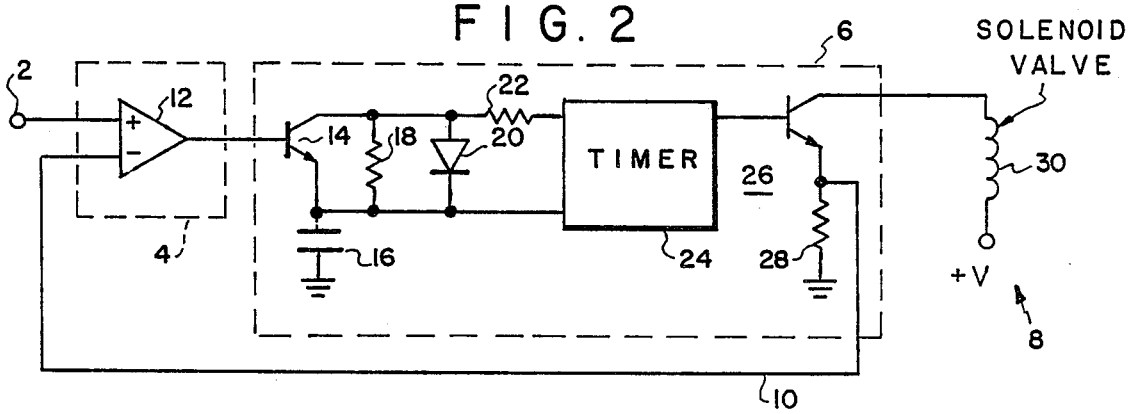
FIG. 2 is a schematic illustration of a proportional solenoid valve power control circuit embodying an example of the present invention for use in the system shown in FIG. 1.

In FIG. 2 there is shown a schematic illustration of a proportional solenoid valve power control circuit embodying an example of the present invention for use in the system shown in FIG. 1. The summing amplifier 4 includes a difference amplifier 12 having its noninverting input connected to the control signal input terminal 2 and its inverting input connected to the feedback signal line 10. The output of the amplifier 12 is connected to the base electrode of a control transistor 14 located in the power control circuit 6. The emitter of the transmitter 14 is connected to ground through a capacitor 16. A first resistor 18 and a first diode 20 are each connected in parallel across the collector emitter electrodes of the transistor 14. The collector electrode of the transistor 14 is connected through a second resistor 22 to a first input of a timer 24 while the emitter electrode of the transistor 14 is also connected to a second input of the timer 24. The output of the timer 24 is connected to the base electrode of a second transistor 26 which is used to control the energizing current to a valve solenoid coil. Thus, the emitter electrode of the second transistor 26 is connected to ground through a third resistor 28 while the collector electrode of the second transistor 26 is connected to a source of voltage +V through a solenoid coil 30 of the valve 8. The feedback line 10 is connected to the junction between the emitter electrode of the second transistor 26 and the third resistor 28 to provide a feedback signal representative of solenoid coil current, i.e., the voltage drop across the emitter resistor 28.

Referring to FIG. 2, the timer 24 is a free-running pulse generator producing an output signal whose frequency is controlled by an input frequency control signal. This control signal is derived from the output signal of the summing amplifier 12 which represents the error between the feedback signal on line 10 representing actual valve lift and input control signal on input terminal 2 representing a desired valve lift. The output of the amplifier 12 controls the charging and discharging rate of the capacitor 16 to produce a corresponding effect on the frequency of the output signal from the timer 24. A more detailed description of the operation of the control circuit of the present invention is provided hereinafter with respect to FIG. 5.

Figure 3:
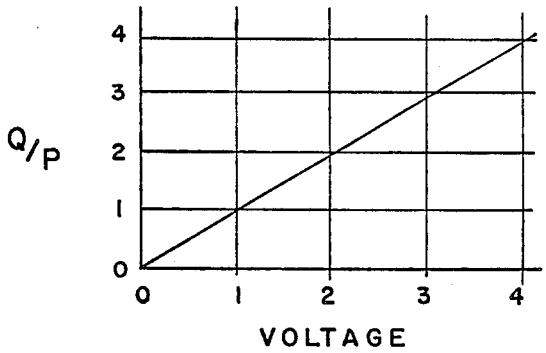
FIG. 3 is a performance diagram showing a typical valve operating characteristic of a proportional valve.
Figure 4:
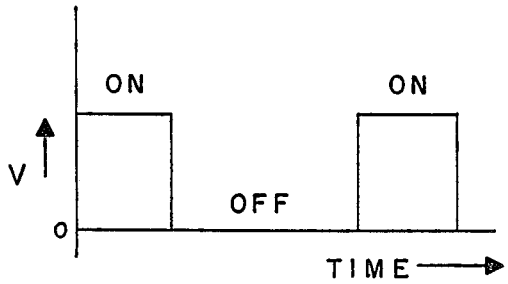
FIG. 4 is a wave-shape diagram showing a control signal produced by the present invention for driving a proportional valve.

In FIG. 3, there is shown a performance diagram of a proportional valve wherein equal increments of a voltage variation applied to the solenoid coil of the valve produced equal changes in the opening of the valve. In FIG. 4, there is shown a wave-shape diagram showing a control signal produced by the circuit shown in FIG. 2 for operating a proportional valve wherein the "off" time of the control signal is adjustable while the "on" time pulses lengths remain constant. Thus, the "off" time is adjustable by the output of the summing amplifier 12 which provides a representation of the error in the position of the armature of the solenoid valve 8.

Figure 5:
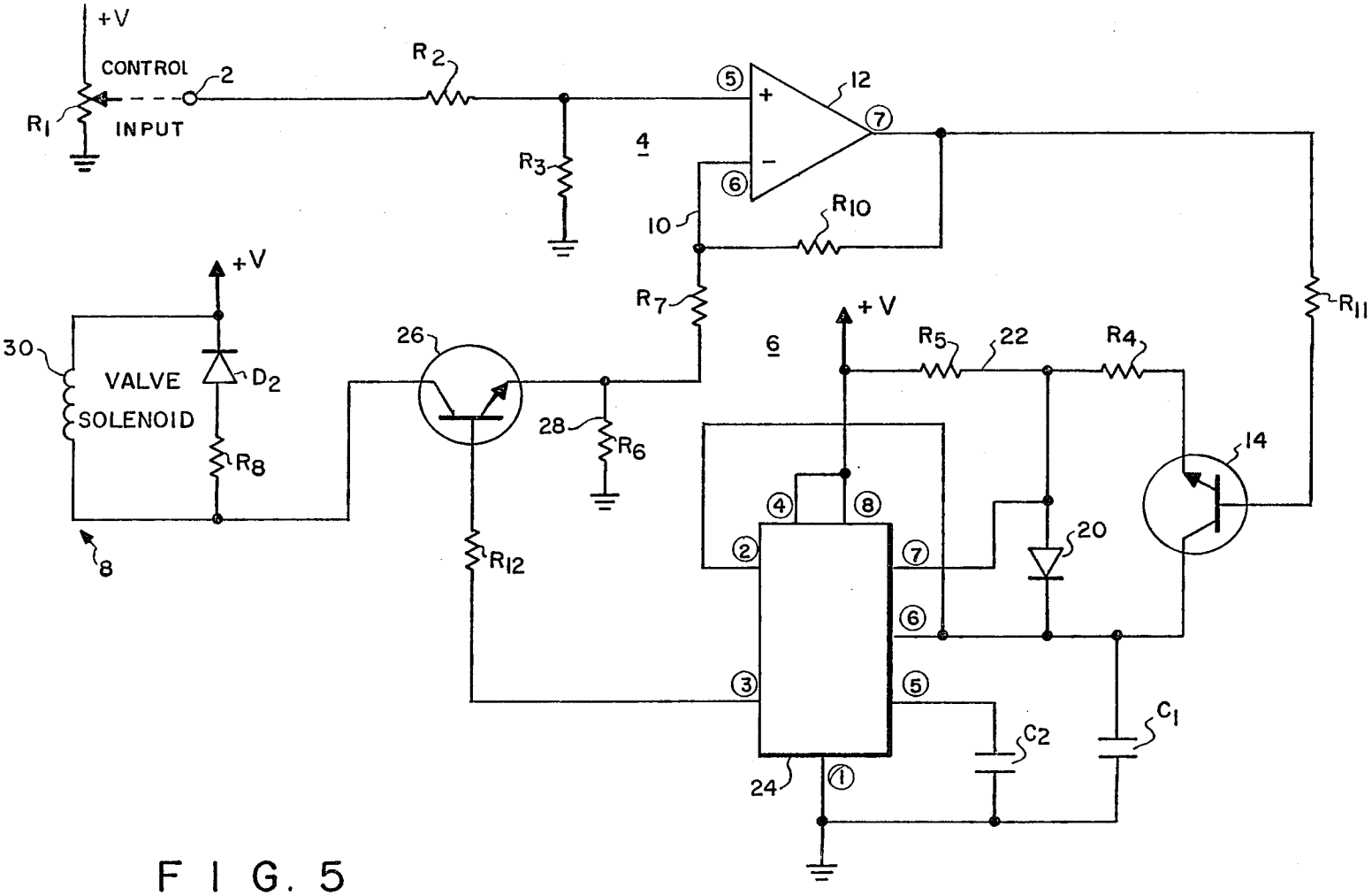
FIG. 5 is a schematic illustration of a specific proportional valve drive circuit for use in the example shown in FIG. 2.

In FIG. 5, there is shown a proportional solenoid valve pulse drive circuit which a specific embodiment of the circuit shown in FIG. 2. Thus, the control input signal supplied to the control input terminal 2 is obtained from a slider on a variable potentiometer resistor R1 connected between the source voltage +V and ground. The control input terminal 2 is connected through an input resistor R2 to the noninverting input of the difference amplifier 12 and through a voltage divider resistor R3 to ground. The output of the difference amplifier 12 is connected to the input of the amplifier 12 through a feedback resistor R10 and to the base electrode of the transistor 14 through a resistor R11. The collector electrode of the transistor 14, which is illustrated as a PNP transistor, is connected through a series pair of resistors R4,R5 to a source of voltage +V. A diode 20 has one end connected to the junction between the resistors R4 and R5. This junction is also connected to the pin ⑦ input of the timer 24 while the pins ④ and ⑧ of the timer 24 are connected to the source of voltage +V. The collector electrode of the transistor 14 is connected through a first capacitor C1 to ground while the pin 5 of the timer 24 is connected through a second capacitor C2 to ground. Pin ② of the timer 24 is connected to timer control pin ⑥ of the timer 24 which is also connected to the collector electrode of the transistor 14. The output ③ of the timer 24 is connected through a resistor R12 to the base electrode of a second transistor 26. The collector electrode of the transistor 26 is connected to ground through the resistor 28 or R6. Concurrently, the collector electrode of the transistor 26 is connected through a resistor R7 to the noninverting input of the amplifier 12 via the feedback line 10 to apply the voltage drop across the resistor 28 to the amplifier 12. The collector electrode of the transistor 26 is connected to one end of the solenoid coil 30 of the valve 8 while the other end of the coil 30 is connected to the voltage source +V. A series combination of a resistor R8 and a second diode D2 are connected across the solenoid coil 30 as a suppressor circuit.

In operation, if the error voltage from the difference amplifier 12 increases positively then the base drive on the first transistor 14 increases and the collector current from the transistor will also increase. This will discharge the capacitor C1 at a faster rate to increase the frequency of the output of the timer 24 which will increase the average current through the solenoid coil 30. Specifically, the control voltage on the control pin ⑥ of the timer 24 will decrease to increase the timer frequency, i.e., decrease the "off" time while maintaining constant width "on" pulses. Concomitantly, this will increase the feedback voltage across R6 and bring the system back into balance through the difference amplifier 12 at a higher frequency. Conversely, if the error voltage decreases, a decrease in frequency and average solenoid current occurs. This accomplishes the goal of mininizing heat dissipation in the control output driver 26 by operating on a pulsed basis and improves the range of proportional control by decreasing the heating of the driver 26. The frequency can be varied from 1 H to 10 kH. This frequency must always be much higher than the frequency to which the valve can respond to to avoid chatter of the valve. An additional benefit can be realized, if required, by selecting a proper value for the capacitor C1 to provide a dither in the control loop to reduce any sticking of the valve armature.

The following is a list of the components used in the circuit shown in FIG. 5:

| | | |
|---|---|---|
| Timer 24 | LM555 | Motorola |
| Amplifier 12 | −324 | Motorola |
| R1 | 10k | |
| R2 | 10k | |
| R3, R12 | 1k | |
| R4 | 2.7k | |
| R5 | 100k | |
| R6 | 2.2 ohms | |
| R8 | 1k | |
| R9 | 10 ohms | |
| C1 | .0047 uF | |
| C2 | .001 uF | |
| Transistor 14 | 2N39 | |
| Transistor 26 | TIP3055 | |
| D1 | 1N9D14 | |
| D2 | 1N4006 | |

Accordingly, it may be seen, that there has been provided, in accordance with the present invention an improved proportional valve control circuit.

The embodiments of the present invention in which an exclusive property or privilege is claimed are defined as follows:

1. A solenoid current control circuit comprising solenoid current driver means, feedback means for providing a feedback signal representative of an output current supplied by said drive means, input signal means for connection to a source of a control signal representative of a desired current to be supplied by said driver means, signal comparison means for comparing said feedback signal with said control signal to produce an error signal representing the difference therebetween, timer means connected to said comparison means for producing an output signal having a frequency dependent on the magnitude of said error signal and circuit means for applying said output signal to said current driver means to produce the output current from said driver means proportional to said output signal.

2. A circuit as set forth in claim 1 wherein said timer means includes a voltage controlled multivibrator.

3. A circuit as set forth in claim 1 wherein said timer means has an output signal frequency which is variable between 1 H and 10 kH.

4. A proportional solenoid valve current control circuit comprising a solenoid coil for operating a proportional solenoid valve, solenoid current driver means for supplying an output current to energize said solenoid coil, feedback means for providing a feedback signal representative of an output current supplied by said drive means, input signal means for connection to a source of a control signal representative of a desired current to be supplied by said driver means, signal comparison means for comparing said feedback signal with said control signal to produce an error signal representing the difference therebetween, timer means connected to said comparison means for producing an output signal having a frequency dependent on the magnitude of said error signal and circuit means for applying said output signal to said current driver means to produce the output current from said driver means proportional to said output signal.

5. A circuit as set forth in claim 4 wherein said timer means includes a voltage controlled multivibrator.

6. A circuit as set forth in claim 4 wherein said timer means has an output signal frequency which is variable between 1 H and 10 kH.

* * * * *